US011013946B2

(12) United States Patent
Lindsey

(10) Patent No.: US 11,013,946 B2
(45) Date of Patent: May 25, 2021

(54) PORTABLE EXERCISE DEVICE

(71) Applicant: Vicki Lindsey, N. Chesterfield, VA (US)

(72) Inventor: Vicki Lindsey, N. Chesterfield, VA (US)

( * ) Notice: Subject to any disclaimer, the term of this patent is extended or adjusted under 35 U.S.C. 154(b) by 0 days.

(21) Appl. No.: 15/869,934

(22) Filed: Jan. 12, 2018

(65) Prior Publication Data

US 2018/0229068 A1 Aug. 16, 2018

Related U.S. Application Data

(60) Provisional application No. 62/445,460, filed on Jan. 12, 2017.

(51) Int. Cl.
*A63B 21/055* (2006.01)
*A63B 21/16* (2006.01)

(52) U.S. Cl.
CPC ..... *A63B 21/0557* (2013.01); *A63B 21/0552* (2013.01); *A63B 21/1609* (2015.10);
(Continued)

(58) Field of Classification Search
CPC ..... A63B 21/0557; A63B 21/0552; A63B 21/1672; A63B 21/1609; A63B 2210/02; A63B 2210/04; A63B 2210/10; A63B 21/16; A63B 21/1618; A63B 21/1627; A63B 21/1645; A63B 21/1654; A63B 21/1663; A61H 2201/5084; A47G 27/02; A47C 21/00
(Continued)

(56) References Cited

U.S. PATENT DOCUMENTS 3,242,506 A * 3/1966 Nack, Jr. ..... A47C 21/026 5/411
4,611,804 A * 9/1986 Addair ..... A63B 21/16 482/131

(Continued)

OTHER PUBLICATIONS (Contraband) Contraband Black Label .Retrieved from Amazon. [Customer Review date Oct. 1, 2015] [Retrieved on May 31, 2019]. Retrieved from the Internet: <url: https:=""www.amazon.com="" contraband-black-label-3inch-double=""dp="" b00qsp3rg0?ref_= "fsclp_pl_dp_4">. <URL: https://www.amazon.com/Contraband-Black-Label-3.*

(Continued)

*Primary Examiner* — Loan B Jimenez
*Assistant Examiner* — Zachary T Moore
(74) *Attorney, Agent, or Firm* — Bernard G. Pike

(57) ABSTRACT

An exercise device includes an adjustable strap to secure the device to a free standing object, such as a piece of furniture having two sections. The strap includes hook fabric portions and a loop fabric portion to adjust to a desired length to fit within the sections of the furniture. The exercise device also includes oval rings to attach to the strap at ends thereof. Each oval ring includes a bar located in its center to engage the strap. The position of the oval rings is secured against the furniture. Attachments for exercising, such as exercise bands, are attached to the oval rings so that a user operates the exercise device as needed, then disassembles the device for storage or to use elsewhere.

9 Claims, 5 Drawing Sheets

(52) U.S. Cl.
CPC ..... *A63B 21/1672* (2015.10); *A63B 2209/10* (2013.01); *A63B 2210/02* (2013.01); *A63B 2210/04* (2013.01)

(58) Field of Classification Search
USPC ..... 482/131; 5/662, 922
See application file for complete search history.

(56) References Cited

U.S. PATENT DOCUMENTS

| | | | | |
|---|---|---|---|---|
| 4,799,675 | A * | 1/1989 | Helmer | A63B 21/0724 128/870 |
| 9,282,829 | B2 * | 3/2016 | Caruso | A63B 21/1672 |
| 2014/0200499 | A1 * | 7/2014 | Champion | A63B 21/1663 602/36 |

OTHER PUBLICATIONS

Amazon, 11-Piece Restraints Kit Under Bed Bondage Ankle Wrist Cuff Restraint Set [online], Published May 9, 2016, [retrieved on Mar. 11, 2020]. Retrieved from the Internet URL: <see in Final-Rejection>. (Year: 2016).*

* cited by examiner

PORTABLE EXERCISE DEVICE

FIELD OF THE INVENTION

The present invention relates to a portable exercise device for use with furniture or other standing objects to provide stability during operation.

DESCRIPTION OF THE RELATED ART

Existing exercise devices require a user to set up the devices to perform any exercises. These devices take up room and are unwieldy to move with the user. Handheld devices may not provide the stability to allow for a complete workout.

SUMMARY OF THE INVENTION

An exercise device is disclosed. The exercise device includes a strap having a loop fabric portion centered within the strap. The strap also includes hook fabric portions positioned at each end thereof. The exercise device also includes a first oval ring and a second oval ring to receive the strap on opposite ends of the strap when the loop fabric portion is connected to the hook fabric portions. Each oval ring includes a bar dissecting a center therein to engage the strap. The exercise device includes at least one attachment to attach to at least one of the oval rings. The at least one attachment configured to move in a direction upon application of a force. The strap is positioned between two sections of furniture such that the first and the second oval rings are located outside the sections to receive the at least one attachment.

An exercise device for use with furniture is disclosed. The exercise device includes a strap made of webbing material that fits between sections of the furniture. The strap includes hook fabric portions having hook material located at opposite ends of the strap. The strap also includes a loop fabric portion having loop material located substantially center of the strap. The exercise device also includes a pair of oval rings placed on opposite curved ends of the strap. Each oval ring includes a center bar to engage the curved ends. The pair of oval rings are located outside the sections of the furniture. The exercise device also includes a first attachment coupled to one of the pair of oval rings. The first attachment provides a resistance for exercise. The exercise device also includes a cuff attached to the first attachment. The cuff includes a cuff hook fabric piece and a cuff loop fabric piece facing each other to hold the cuff in place.

BRIEF DESCRIPTION OF THE DRAWINGS

Various other features and attendant advantages of the present invention will be more fully appreciated as the same becomes better understood when considered in conjunction with the accompanying drawings.

DETAILED DESCRIPTION OF THE PREFERRED EMBODIMENTS

Reference will now be made in detail to specific embodiments of the present invention. Examples of these embodiments are illustrated in the accompanying drawings. While the embodiments will be described in conjunction with the drawings, it will be understood that the following description is not intended to limit the present invention to any one embodiment. On the contrary, the following description is intended to cover alternatives, modifications, and equivalents as may be included within the spirit and scope of the appended claims. Numerous specific details are set forth in order to provide a thorough understanding of the present invention.

According to some embodiments, the exercise device is placed between two sections of furniture to stabilize and secure the device for use. The user may configure the exercise device for use with the furniture then remove the device for storage. The user also may take the exercise device and use it in conjunction with other furniture or free standing objects. This feature allows the exercise device to be portable. It also may be stored away when not in use so that room is not taken up by the device or it is not an eye sore when in use. The user may merely cover the parts of the device located outside the furniture.

Figure 1:
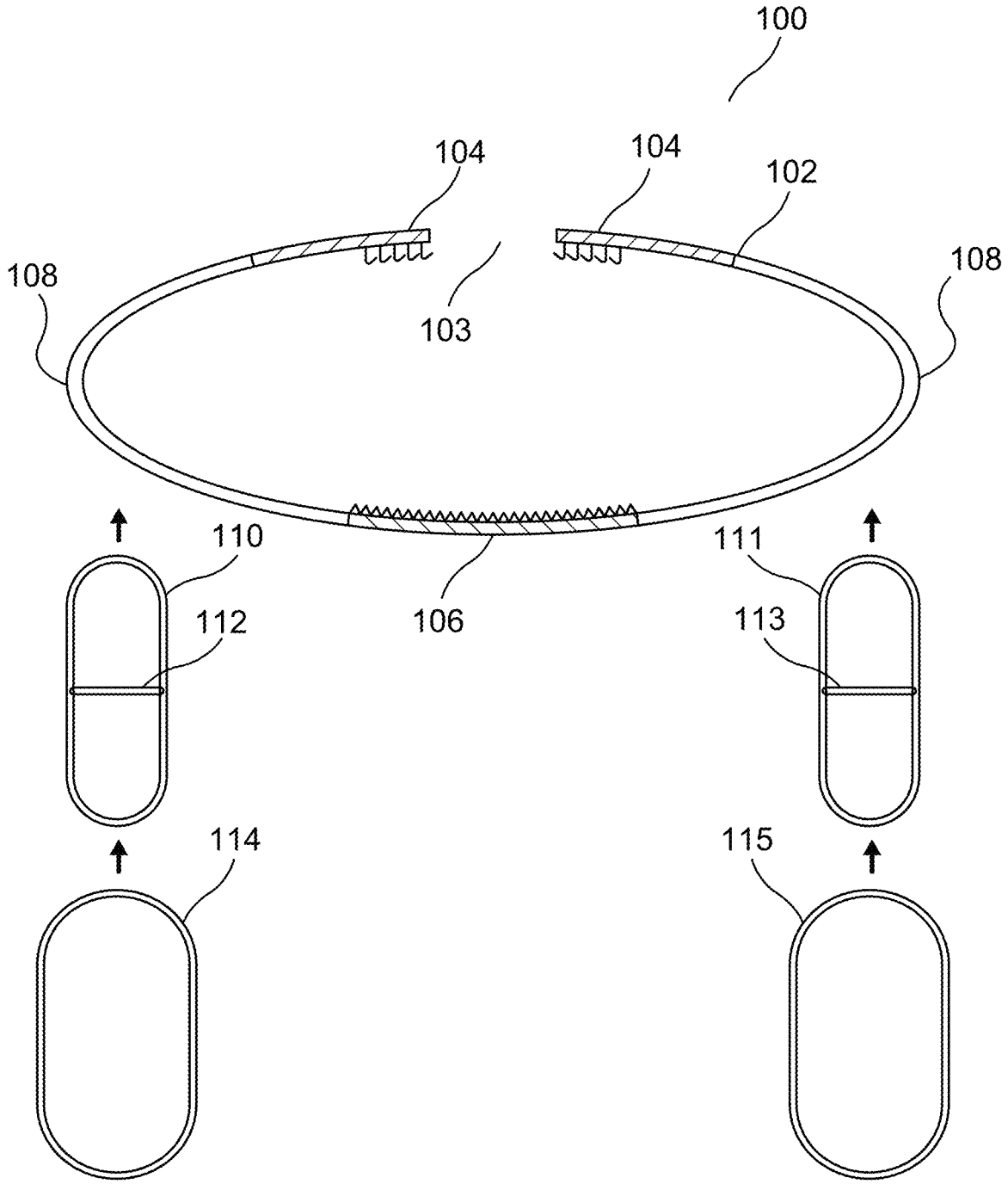
FIG. 1 illustrates an exercise device according to the disclosed embodiments.

FIG. 1 depicts an exercise device 100 according to the disclosed embodiments. Exercise device 100 may be used by an individual to build strength and flexibility in the comfort of their home or a room that has furniture, such as a bed, to mount the device. The user may take exercise device 100 with him/her as needed or even use it in different rooms or locations with the home. When not in use, exercise device 100 may be broken down and stored without the need for substantial space. It also does not divert attention away from the rest of the room, such as a treadmill or weight lifting machine. Exercise device 100 also may be set up easily and with little hassle by a user having little or no experience with fitness programs.

Exercise device 100 includes strap 102. Strap 102 may be comprised of webbing material, such as that used in a seat belt. Such material provides stability and strength while being flexible enough to attach to any variety of furniture or free standing objects. The webbing material of strap 102 also may stretch or deform slightly, but not completely. As will be discussed below, exercise device 102 should not stretch or deform in a substantial manner.

Strap 102 includes hook fabric portions 104 and a loop fabric portion 106. These portions provide the scalability of exercise device 100 to fit a variety of furniture. These features also are disclosed in greater detail below. Hook fabric portions 104 are attached to loop fabric portion 106 as that strap 102 can have a desired length. For example, the left side hook fabric portion 104 may be attached to loop fabric portion 106 towards its middle while the right side hook fabric portion 104 is attached to a right end of portion 106. Hook fabric portions 104 may be referred to as "rough material" and loop fabric portion 106 may be referred to as soft material because the hooks in portions 104 are rigid when compared to the loops of portion 106.

An opening 103 of strap 102 provided by hook fabric portions 104 enable attachment of oval rings 110 and 111. The oval rings are disclosed in greater detail below. Oval ring 110 includes a bar 112 while oval ring 111 includes a bar 113. Preferably bars 112 and 113 are located center within oval rings 110 and 111, respectively. The bars dissect the oval rings. Bars 112 and 113 engage strap 102 by placing hook fabric portions 104 through oval rings 110 and 111 such that curved ends 108 of strap 102 are located on an outwardly facing portion of the bars. Oval rings 110 and 111 are secured to strap 102 when hook fabric portions 104 are attached to loop fabric portion 106. As shown below, portions of the furniture secure exercise device 100 such that oval rings 110 and 111 are positioned outside the furniture for access by the user.

Attachments 114 and 115 are attached to oval rings 110 and 111, respectively. Additional attachments may be used with exercise device 100. These attachments are shown for illustrative purposes. In some embodiments, one or more attachments may be an exercise band used for stretching and resistance training. The user may pull the exercise band to perform exercises. In some embodiments, the attachments are tied to the oval rings. In other embodiments, the attachments may be connected to the oval rings using a connection mechanism, such as a snap portion. Attachments 114 and 115 also may include cuffs, as disclosed below.

Figure 2:
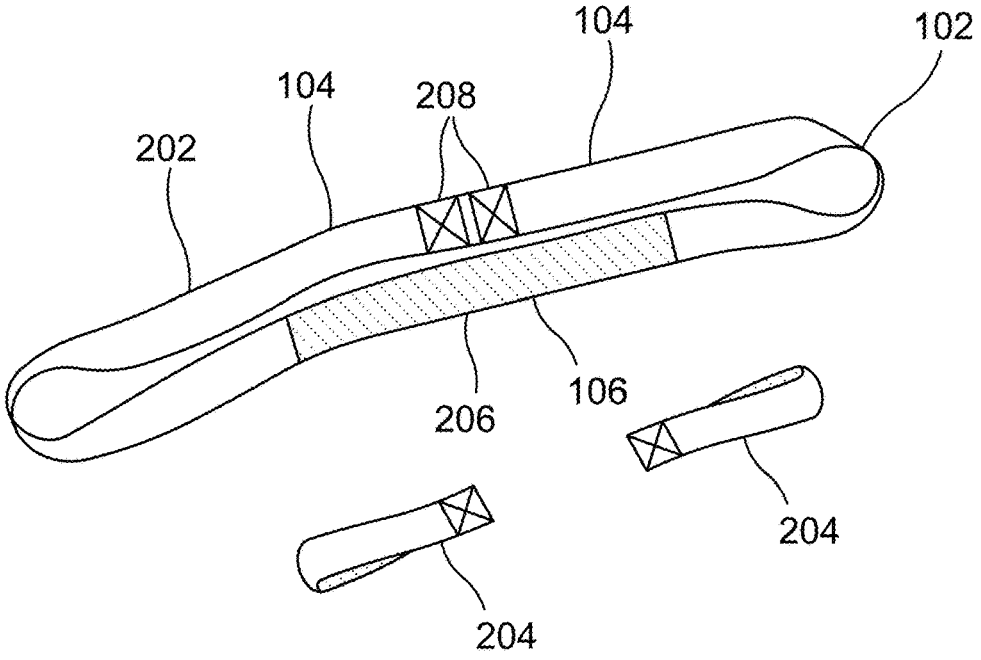
FIG. 2 illustrates a strap according to the disclosed embodiments.

FIG. 2 depicts strap 102 according to the disclosed embodiments. FIG. 2 shows webbing material 202 used in strap 102. Hook fabric portions 104 are shown placed adjacent to each other such that opening 103 is closed. As can be seen, hook fabric portions 104 face loop fabric portion 106 so that the portions may be attached together. The length of strap 102 may be adjusted by placing hook fabric portions 104 at different locations on loop fabric portion 106. Detached hook fabric portions 204 are shown. This feature highlights that the hook fabric portions may be sewn onto strap 102 into webbing material 202. The loop fabric material also may be sewn onto strap 102. Alternatively, detached hook fabric portions 204 may be attached to strap 102 in that different lengths of detached hook fabric portions may be provided with exercise device 100. The user attaches a desired length of the detached hook fabric portions to lengthen strap 102 as needed. Moreover, as the hooks within the detached hook fabric portions wear down, the portions may be replaced to prolong the use of exercise device 100.

In some embodiments, strap 102 may include the following dimensions and parameters. The width of strap 102 may be about two inches. A preferred length may be about 10 feet. From a center point 206 of strap 102, loop fabric portion 106 extends at least two feet in both directions along strap 102. More preferably, loop fabric portion 106 extends about two feet and five inches from center point 206 for a total length of the loop fabric portion of about four feet and ten inches. The preferred length of hook fabric portions 104 may be about two feet. Hook fabric portions 104 also may include ends 208. Ends 208 may include a pattern or other distinctive feature that allows one to know the ends by touch. This aspect may help when connecting or disconnecting the hook fabric portions.

Figure 3A:
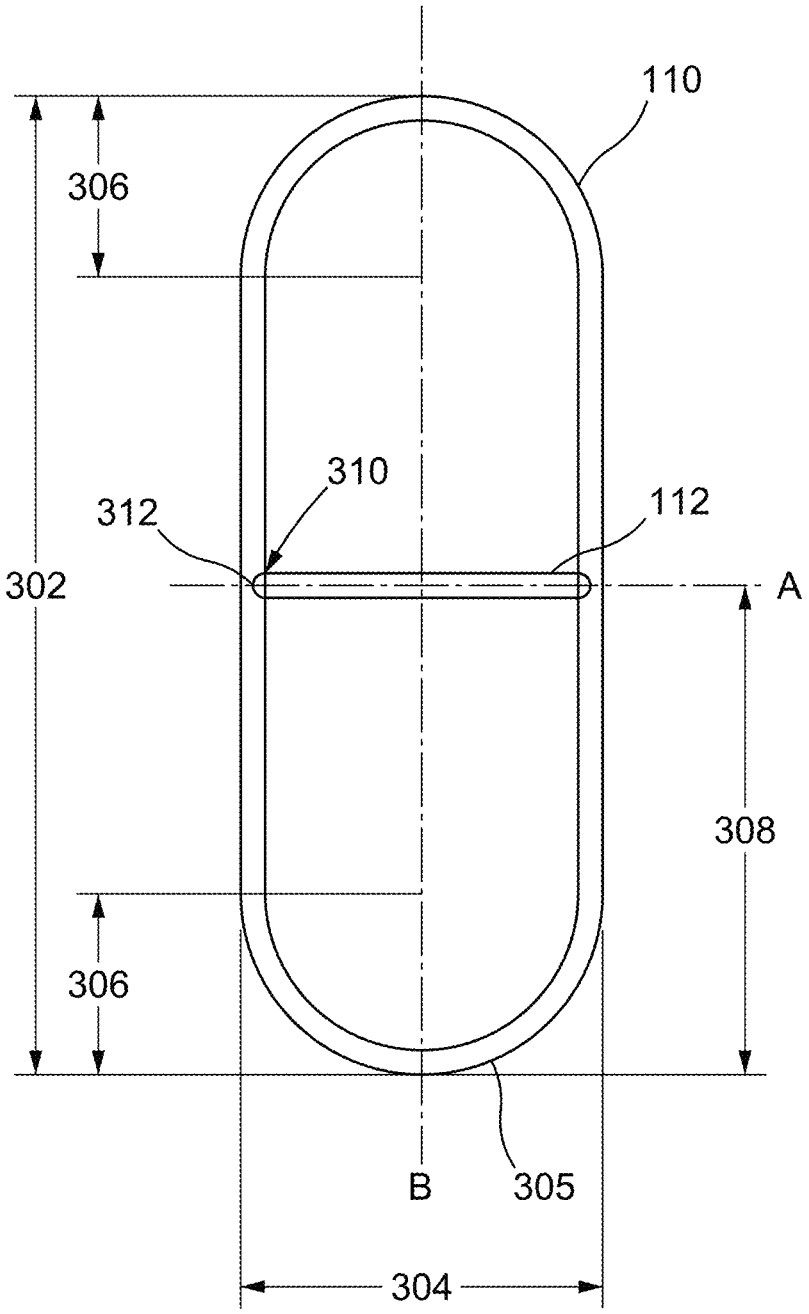
FIG. 3A illustrates a front view of an oval ring according to the disclosed embodiments.
Figure 3B:
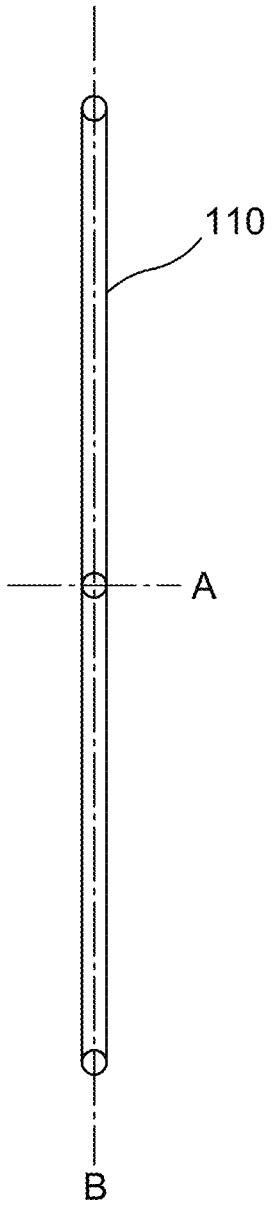
FIG. 3B illustrates a side view of the oval ring according to the disclosed embodiments.

FIGS. 3A and 3B depict an example of an oval ring according to the disclosed embodiments. FIG. 3A may show a front or back view of the oval ring. FIG. 3B may show a side view of the oval ring. Oval ring 110 is shown, but the disclosed embodiments also may apply to oval ring 111. As noted above, exercise device 100 implements two oval rings, one on each curved end 108 of strap 102. Axis A may bisect oval ring 110 in a direction between the sides of the ring. Axis B may bisect oval ring 110 in a direction between the top and bottom of the ring.

Preferably, oval ring 110 is comprised of stainless steel. Stainless steel provides the support for use of the attachments for exercises. It also may be smooth so as to not damage the furniture when exercise device 100 is assembled. Oval ring 110 also may have preferred dimensions. It may have an overall length 302 of about 5.5 inches. Oval ring 110 also may have a width 304 of about 2 to 2.5 inches. Oval ring 110 includes center bar 112. A length 308 from the center bar to each end of oval ring 110 may be about 2.75 inches. Other dimensions include a radius 306 of curved portions 305 of about 1 inch.

Center bar 112 may be secured to oval ring 110 with a portion 310 placed into seat 312. Seat 312 may allow center bar 112 to be secured within oval ring 110 so that it does not dislodge when exercise device 100 is in use. When the user applies a force to attachment 114 or 115, stress will be placed upon center 112 as oval ring 110 is pulled in the direction of the force. In other embodiments, center bar 112 may be joined to oval ring 110.

Preferably, exercise device 100 includes two oval rings. Webbing material 202 of strap 102 is passed through the oval rings to wrap around the center bars. In some embodiments, a connection device may be included in strap 102 that is adjustable along curved ends 108 to accommodate the oval rings and allow different lengths for strap 102.

Figure 4:
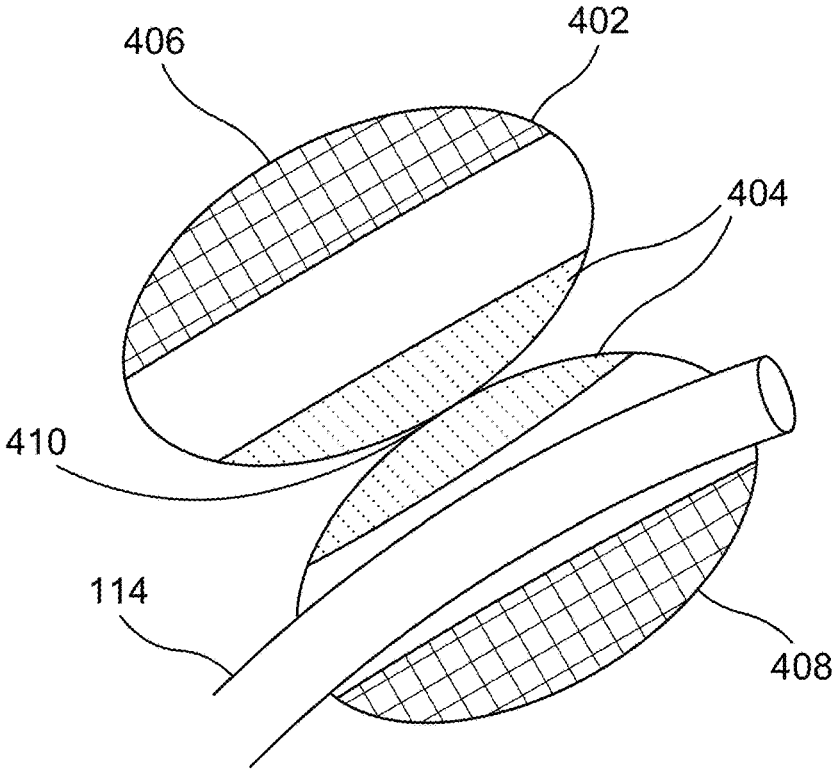
FIG. 4 illustrates a cuff for an attachment according to the disclosed embodiments.

FIG. 4 depicts a cuff 402 for use with an attachment 114 (or 115) according to the disclosed embodiments. Cuffs allow the user to grasp an attachment to an oval ring without wearing down the attachment or discomfort to the user. Instead of cuffs, other items may be attached, such as loops or bands that allow the user to place his/her foot or leg through the item to use the attachment.

Cuff 402 includes leather material 404. Leather material 404 may be sewn onto the cuff and placed where the user grasps attachment 114. In other embodiments, cuff 402 may be made partially or entirely of leather. Alternatively, cuff 402 may be comprised of other soft material or foam that provides a buffer between the hand, foot, arm, leg, and the like of the user and attachment 114. Cuff hook fabric piece 406 and cuff loop fabric piece 408 also are included to close cuff 402 around attachment 114. In some embodiments, cuff 402 is made entirely of leather material and pieces 406 and 408 sewn thereto. Leather material 404 allows the user to exercise using exercise device 100 without undue pain or bruising during resistance training and exercise. Cuff 402 includes a center portion that separates the two parts of the cuff and allows it to open for fitting onto attachment 114.

Figure 5:
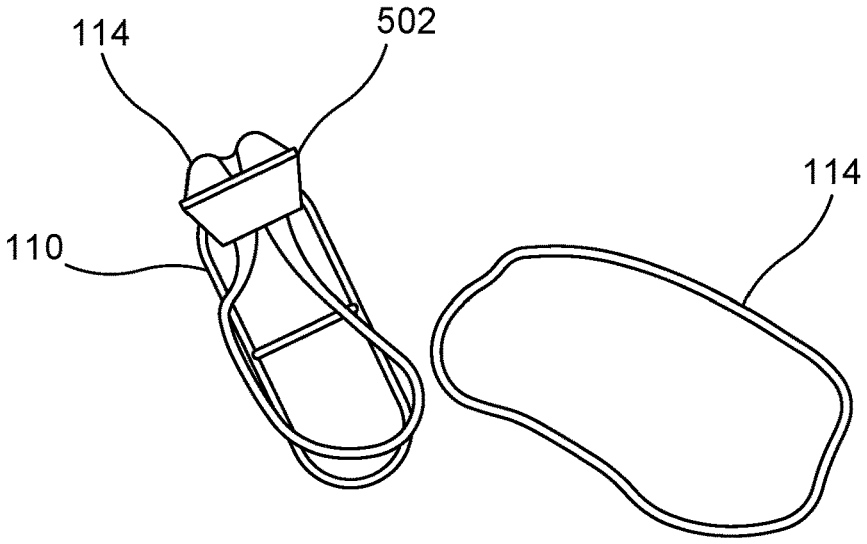
FIG. 5 illustrates attachments for use with an oval ring according to the disclosed embodiments.

FIG. 5 depicts attachments 114 being attached to oval ring 110. When implemented, strap 102 engages center bar 112, which is held in place by the furniture. The user applies a force to attachment 114 to do movements with resistance provided by the materials in the attachment. Preferably, attachment 114 is an exercise band that stretches and deforms to provide resistance training for the user. Knot 502 attaches attachment 114 to oval ring 110. Any variety of knots may be used for knot 502. Other forms of attachment also may be used.

In some embodiments, additional attachments 114 may be used to vary training. For example, a second attachment 114 may be attached to the attachment on oval ring 110 to lengthen the overall exercise attachment of exercise device 100. Alternatively, the second attachment also may be attached to oval ring 110 to provide double the resistance for more intense training. Cuffs 402 may be attached to each attachment.

Figure 6A:
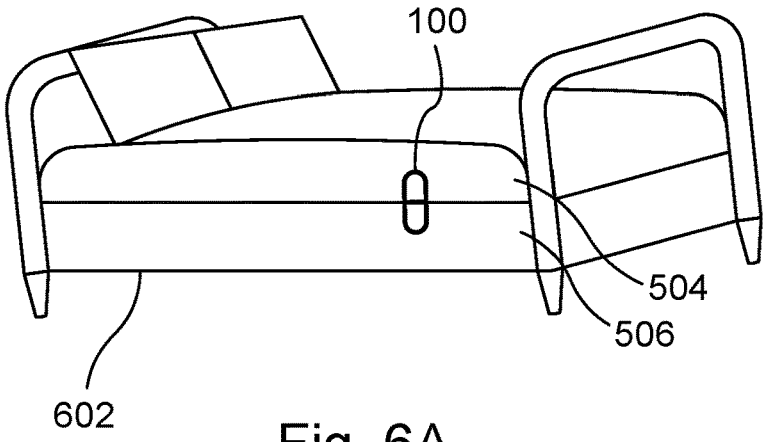
FIG. 6A illustrates a side view of furniture with the exercise device according to the disclosed embodiments.
Figure 6B:
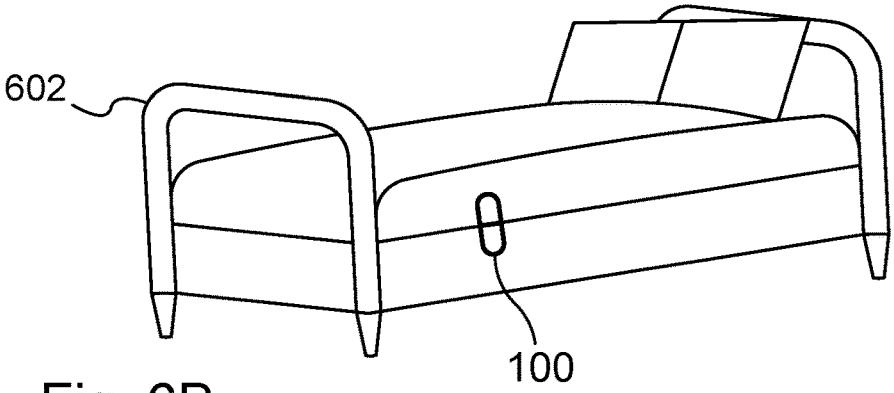
FIG. 6B illustrates another side view of furniture with the exercise device according to the disclosed embodiments.
Figure 6C:
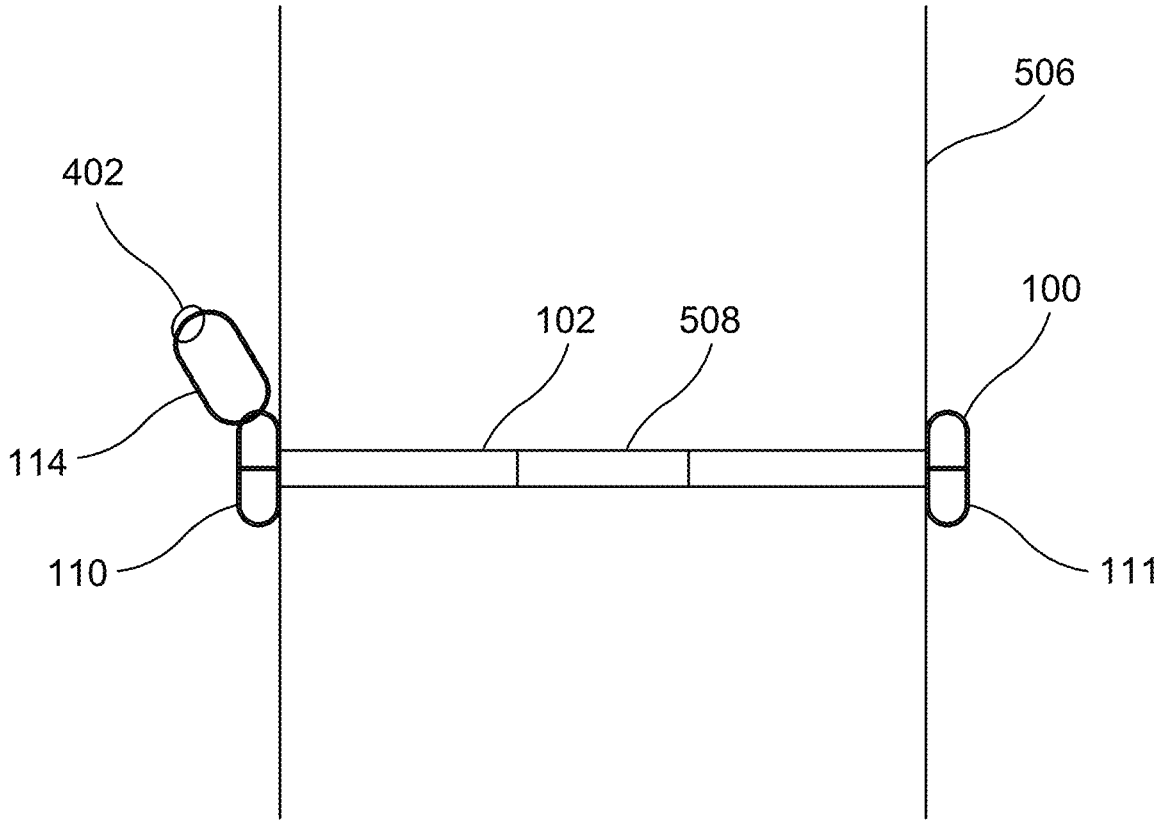
FIG. 6C illustrates a top view of exercise device being used with furniture according to the disclosed embodiments.

FIGS. 6A, 6B, and 6C depict exercise device 100 configured to be used with bed 602. Bed 602 includes two sections 504 and 506. Sections 504 and 506 are separable in that exercise device 100 is placed between the sections. As shown in FIG. 6C, exercise device 100 may be place on top of section 506. Oval rings 110 and 111 are placed on opposite sides of section 506. In this configuration, a force applied to one oval ring will be resisted by the other oval ring held in place by the furniture. As disclosed above, strap 102 is adjustable such that it can fit any type of furniture.

Exercise device 100 also includes attachment 114 attached to oval ring 110. An attachment 114 also may be attached to oval ring 111 on the other side of exercise device 100. As shown in FIGS. 6A and 6B, only the oval rings are visible when exercise device 100 is implemented. Thus, exercise device 100 does not take up space in a room or need special structures to use. It uses a bed already in place. Further, exercise device 100 does not distract from the appearance of the bed. The oval rings may be covered. Attachments 114 may be removed.

Strap 102 is comprised of webbing material 202 such that it does not stretch or deform during use. It also does not damage bed 602. Hoop fabric portions 104 and loop fabric portion 106 face inwardly so that these portions do not snag or damage bed 602. In some embodiments, a cover 508 may be placed over portions 104 and 106 to prevent any possible damage caused by exercise device 100.

When not in use, exercise device 100 may be kept in place as supported by furniture 502. The other components of device 100 may be stored between sections 504 and 506. When one wants to remove the device from the furniture, exercise device 100 may be broken down by disconnecting portions 104 and 106 from each other. Oval rings 110 and 111 may be removed by sliding strap 102 off centers bars 112 and 113. Attachments 114 may be untied from the oval rings. Exercise device 100 then may be stored in a box or drawer. Another feature of the disclosed embodiments is that the user can use the exercise device at his/her leisure in the comfort of home.

Exercise device 100 also is portable in that it may be taken with the user to other rooms, trips, and the like. It may be used with any type of furniture that has sections to accommodate strap 102. Thus, if the user is unable to go to a gym or is at a hotel without one, then he/she can still perform exercises by setting up exercise device 100. It also may be preferable for a user with disability or injury in that it can be easily configured with existing furniture for use without expensive adaptations or changes to the existing furniture.

In other embodiments, two pieces of furniture may be placed together with exercise device 100 located therebetween. For example, a chair may be placed against a bed 602, with strap 102 placed at the intersection of the pieces of furniture. Strap 102 may be adjusted so that oval rings 110 and 111 are accessible to the user for attachments 114 and 115. Thus, exercise device 100 may be used with a bed that secures the device during exercises.

It will be apparent to those skilled in the art that various modifications may be implemented to the disclosed portable exercise device without departing from the spirit or scope of the invention. Thus, it is intended that the present invention covers the modifications and variations disclosed above provided that these changes come within the scope of the claims and their equivalents.

The invention claimed is:

1. An exercise device comprising:

a strap comprising a webbing material such that the strap does not stretch, the strap comprising:

a loop fabric portion centered within on the strap, and hook fabric portions positioned at each end of the strap;

a first oval ring and a second oval ring, wherein each oval ring includes comprises a center bar dissecting the oval ring and the strap is passed through the oval ring to wrap around the center bar to attach the oval rings such that curved ends of the strap are located on an outwardly facing portion of the bars; and a first exercise band connected to at least one of the oval rings, wherein the exercise band stretches and deforms to provide resistance training for a user;

wherein the strap is positioned between two sections of a bed such that the first and the second oval rings are located outside the sections of the bed and perpendicular to the strap such that a force applied to one oval ring will be resisted by the other oval ring held in place by the two sections of the bed.

2. The exercise device of claim 1, comprising a second exercise band such that the second exercise band is connected to second oval ring.

3. The exercise device of claim 1, further comprising a cuff attached to the first exercise band, wherein the cuff includes a leather portion.

4. The exercise device of claim 3, wherein the cuff includes a cuff loop fabric portion and a cuff hook fabric portion.

5. The exercise device of claim 1, wherein the first oval ring and the second oval ring are comprised of stainless steel.

6. The exercise device of claim 1, wherein the loop fabric and hook fabric portions are sewn into the strap.

7. The exercise device of claim 1, wherein the first exercise band includes a stretchable portion.

8. The exercise device of claim 1, wherein the bed includes the two sections having a top section and a bottom section and wherein the strap is placed between the top section and the bottom section.

9. An exercise device comprising:

a strap comprising a webbing material such that the strap does not stretch during use, the strap comprising:

a loop fabric portion centered on the strap, and hook fabric portions positioned at each end of the strap;

a first oval ring and a second oval ring, wherein each oval ring comprises a center bar dissecting the oval ring and the strap is wrapped around the center bar to attach the oval rings such that curved ends of the strap are located on an outwardly facing portion of the bars; and a first exercise band connected to the first oval ring, wherein the exercise band stretches and deforms to provide resistance training for a user and the strap is positioned between two sections of a bed such that the first and the second oval rings are located completely outside the sections of the bed such that a force applied to one oval ring will be resisted by the other oval ring held in place by the two sections of the bed.

* * * * *